US006786842B1

(12) United States Patent
Nasiatka

(10) Patent No.: US 6,786,842 B1
(45) Date of Patent: Sep. 7, 2004

(54) BASE ANCHORING ASSEMBLY

(76) Inventor: Frank E. Nasiatka, 185 Plainfield, Dearborn Heights, MI (US) 48127

( * ) Notice: Subject to any disclaimer, the term of this patent is extended or adjusted under 35 U.S.C. 154(b) by 0 days.

(21) Appl. No.: 10/412,845

(22) Filed: Apr. 15, 2003

(51) Int. Cl.[7] ..... A63B 71/00
(52) U.S. Cl. ..... 473/499
(58) Field of Search ..... 473/499–501, 473/502–504

(56) References Cited

U.S. PATENT DOCUMENTS

| | | | | | |
|---|---|---|---|---|---|
| 948,342 | A | * | 2/1910 | Pisel | 473/499 |
| 2,471,736 | A | | 5/1949 | Gleming et al. | |
| 2,494,511 | A | * | 1/1950 | Josselson | 473/499 |
| 2,624,580 | A | * | 1/1953 | Corbett | 473/499 |
| 2,695,784 | A | | 11/1954 | Orsatti et al. | |
| 2,756,999 | A | * | 7/1956 | Orsatti | 473/499 |
| 3,815,905 | A | * | 6/1974 | Golomb | 473/499 |
| 3,836,146 | A | | 9/1974 | Golumb | |
| 3,971,558 | A | * | 7/1976 | Gardetto | 473/499 |
| 4,162,789 | A | * | 7/1979 | Hollaway | 473/499 |
| 4,405,130 | A | * | 9/1983 | Mullany | 473/499 |
| 4,448,414 | A | * | 5/1984 | Gutierrez | 473/499 |
| 4,493,486 | A | | 1/1985 | Fuller et al. | |
| 4,915,383 | A | | 4/1990 | Yamakuchi et al. | |
| 5,263,710 | A | * | 11/1993 | Blumer et al. | 473/501 |
| 5,454,560 | A | * | 10/1995 | Pan | 473/499 |
| 5,607,150 | A | * | 3/1997 | Schnorr, III | 473/499 |

* cited by examiner

*Primary Examiner*—Mitra Aryanpour
(74) *Attorney, Agent, or Firm*—Charles W. Chandler

(57) ABSTRACT

A base assembly for playing softball has a base, and a ground-engaging elongated plate on the bottom side of the base. The plate is elongated, stiff and has a length greater than the width of the base. A strap passes horizontally through the sides of the base and then through slots in the plate. The strap ends are folded back and fastened to the bottom side of the plate in a tight fitting arrangement. A pair of spikes are received through openings adjacent the ends of the plate to anchor the base to the ground.

6 Claims, 2 Drawing Sheets

BASE ANCHORING ASSEMBLY

BACKGROUND AND SUMMARY OF THE INVENTION

This invention is related to bases used in the game of baseball, softball, and similar sports using bases, and more particularly to the construction of a base having a system for anchoring the base to the ground.

Bases used in playing softball are temporarily anchored to the ground for a game. Frequently a base must be relocated to different locations depending upon the age of the players. Younger players have a shorter baseline distance than adult players. Further, in many cases, bases must be removed after each game to avoid theft.

The standard practice is to drive a couple of stakes into the ground that are spaced approximately the width of the bag. The bags have straps that are threaded through the eyes of the stakes and then buckled down. This process is unsatisfactory, because the straps cannot be adequately tightened and consequently are loose.

Prior art related to this problem, includes U.S. Pat. No. 4,915,383 issued Apr. 10, 1990 to Betty F. Yamakuchi et al. for "Base for Little League Baseball Field"; U.S. Pat. No. 4,493,486 issued Jan. 15, 1985 to Charles C. Fuller for "Ball Base Construction Anchor" U.S. Pat. No. 3,836,146 issued Sep. 17, 1974 to David L. Golomb for "Baseball Base Ground Fastening Device"; U.S. Pat. No. 2,695,784 issued Nov. 30, 1954 to Louis A. Orsatti et al. for "Baseball Base Anchoring Device"; and U.S. Pat. No. 2,471,736 issued May 31, 1949 to John G. Fleming for "Baseball Base"

The broad purpose of the present invention is to provide a base having an improved anchoring arrangement. The base is 15" square with 3" sidewalls and includes a core covered by fabric covering. An elongated plastic plate is disposed on the bottom side of the base with the plate's ends extending 1½" beyond the opposite sides of the base.

A horizontal strap is passed through the base with the ends of the strap exiting through slits in the opposite sides of the base. The strap ends are threaded through slots in the plate and then tightly fastened to the bottom side of the plate. A pair of spikes is then inserted through openings adjacent the extreme ends of the plate to anchor the plate to the ground.

This arrangement provides an improved means for anchoring the base to the ground while permitting the base to be easily removed for relocation.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views and in which.

DESCRIPTION OF THE PREFERRED EMBODIMENT

Figure 1:
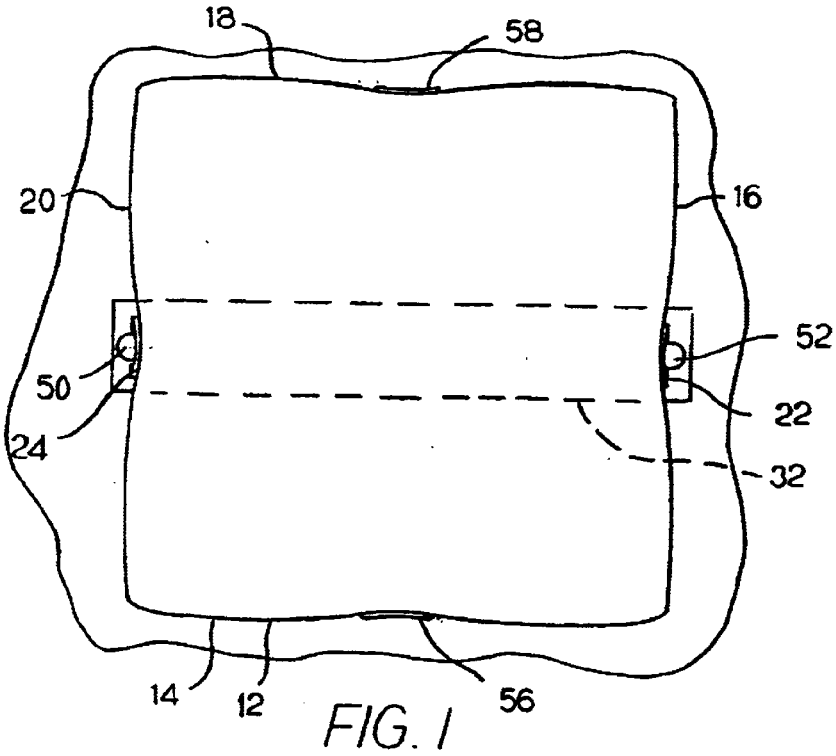
FIG. 1 is a plan view of a base with an anchoring assembly illustrating in the preferred embodiment of the invention.

Referring to the drawings, a base 10 has an inner core 11 and a cover 12 of a fabric-like material. The base has four sides 14, 16, 18 and 20. The base is 15" square and 3" thick. Sides 16 and 18 each have slits 22 and 24 respectively. The slits are in the mid-section of the sides and are about 1¾" wide.

A strap 26 is passed through the base parallel to the bottom surface. Strap ends 28 and 30 exit through openings 22 and 24 and have a length such that each of the straps can be folded down parallel to the bottom side of the base.

An elongated plate 32 is mounted on the bottom side of the base. The plate is formed of a stiff plastic or other rigid material and is 17" long, 3" wide and ½" thick. The plate has a pair of slots 34 and 36 for receiving the ends of the strap. Preferably each slot is about 2" long and ½" wide. Thus the length of each slot is slightly longer than the width of the strap.

Figure 3:
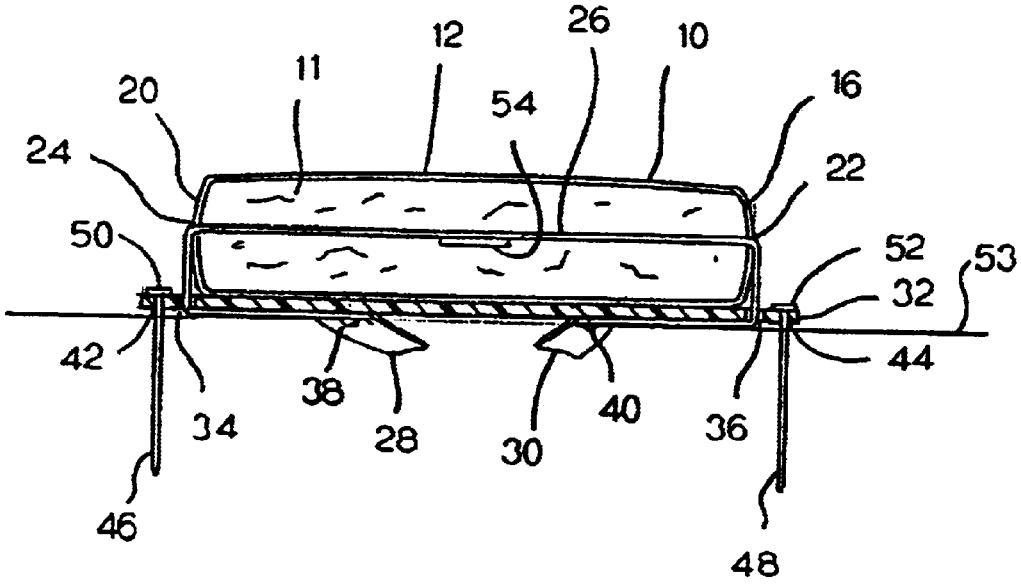
FIG. 3 is a sectional view through the preferred base and anchoring assembly.

Referring to FIG. 3, the ends of the strap are tightly pulled through the base, down through slots 34 and 36 and then fastened by threaded fasteners 38 and 40 to the plate. Thus the strap, the base and the plate form a tight-fitting assembly.

The ends of the plate beyond the belt-receiving slots have a pair of spike receiving openings 42 and 44. The openings are about ½" in diameter. Spikes 46 and 48 are received in the two openings 42 and 44, respectively. The spikes have heads 50 and 52 that are larger than the diameter of opening 42 and 44 and have a length of about 8", similar to rain gutter spikes so that they can be firmly embedded in ground 50. The two spikes are easily driven into the ground and provide a better anchoring means than a single spike arrangement. Further the stiff plate can be tightly fastened to the base to form a tight assembly.

Figure 2:
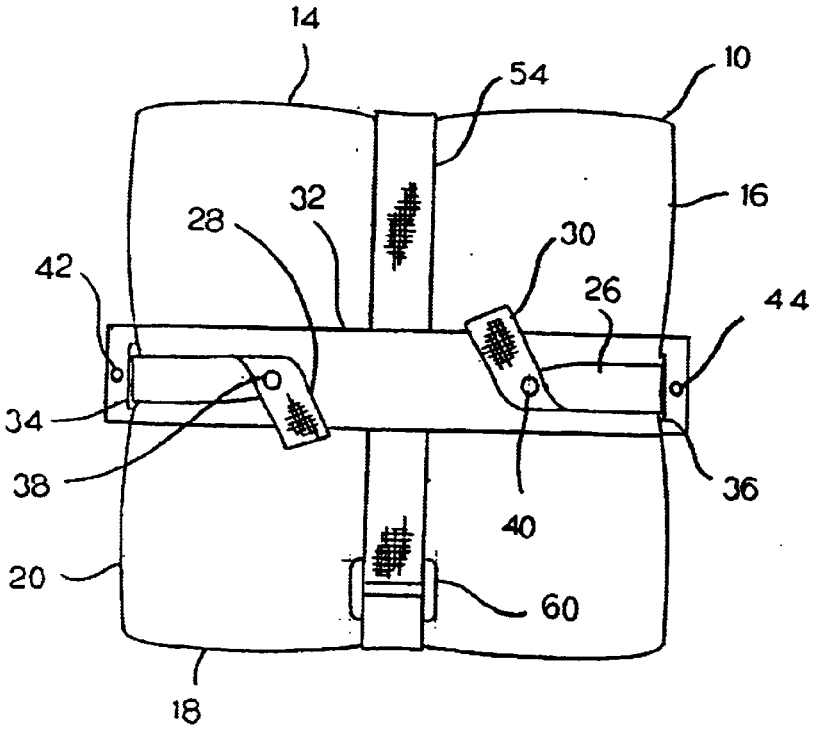
FIG. 2 is a bottom view of the base and anchoring assembly of FIG. 1.

Referring to FIGS. 1 and 3, a second elongated strap 54 has its ends extending through a second pair of slits 56 and 58 in sides 12 and 18 of the base. Strap 54 has its ends joined together by a buckle 60 as illustrated in FIG. 2. The second strap is supplied with commercially available bases, but is unnecessary for practicing this invention.

Having described my invention, I claim:

1. A base assembly suited to be anchored in the ground, comprising:

a base having an outer cover, a bottom surface, and a pair of spaced side surfaces having a pair of oppositely disposed cover slits;

a strap inserted through said pair of cover slits, said strap having a first end, and a second end;

a planar, rigid, elongated plate, having a length greater than the dimension of the bottom surface of the base between said cover slits;

the plate having a pair of strap-receiving plate slots for receiving the strap ends, said plate slots being spaced a distance corresponding to the distance between said cover slits;

the plate being disposed in a face-to-face relationship with the bottom surface of the base, the plate having a pair of spike-receiving openings located outwardly of the strap-receiving slots for receiving a pair of spikes;

means for fastening said first and second strap ends to the plate;

a pair of spikes receivable through said spike-receiving openings; and whereby the base may be anchored to the ground by laying the base and the plate on the ground in a selected location and then driving the spikes into the ground through said spike-receiving openings.

2. A base assembly as defined in claim 1, in which the spikes are each about 8" long.

3. A base assembly as defined in claim 1, in which the base has a second pair of side surfaces disposed at right angles to the first pair of side surfaces, the second pair of side surfaces having a second pair of oppositely disposed cover slits, and including a second strap received therein and having ends connected together.

4. A base assembly as defined in claim 1, in which the plate is formed of a plastic material.

5. A base assembly as defined in claim 1, in which the base has a width of 15", and the plate has a width of 3", and a length of 17".

6. A base assembly as defined in claim 1, in which the straps are folded toward one another and fastened to the base in a position between the strap-receiving slots.

* * * * *